US009766564B2

(12) United States Patent
Fujisaki et al.

(10) Patent No.: US 9,766,564 B2
(45) **Date of Patent: *Sep. 19, 2017**

(54) ELECTROSTATIC CHARGE IMAGE DEVELOPING TONER AND MANUFACTURING METHOD OF THE SAME

(71) Applicant: Konica Minolta, Inc., Tokyo (JP)

(72) Inventors: Natsuko Fujisaki, Hino (JP); Tomomi Oshiba, Hachioji (JP); Makoto Nomiya, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/083,763

(22) Filed: Mar. 29, 2016

(65) Prior Publication Data

US 2016/0291492 A1 Oct. 6, 2016

(30) Foreign Application Priority Data

Mar. 30, 2015 (JP) ..... 2015-069992

(51) Int. Cl.

| | |
|---|---|
| ***G03G 9/087*** | (2006.01) |
| ***G03G 9/093*** | (2006.01) |
| ***G03G 9/08*** | (2006.01) |

(52) U.S. Cl.

CPC ..... *G03G 9/08755* (2013.01); *G03G 9/0804* (2013.01); *G03G 9/09392* (2013.01)

(58) Field of Classification Search

CPC ..... G03G 9/08755

See application file for complete search history.

(56) References Cited

U.S. PATENT DOCUMENTS

| | | | | |
|---|---|---|---|---|
| 2006/0057483 | A1* | 3/2006 | Yanase | G03G 9/0825 430/108.4 |
| 2016/0246198 | A1* | 8/2016 | Fujisaki | G03G 9/08755 |

FOREIGN PATENT DOCUMENTS

| | | | |
|---|---|---|---|
| JP | 2006-106727 | A | 4/2006 |
| JP | 2009229920 | A | 10/2009 |
| JP | 2011-053494 | A | 3/2011 |
| JP | 2013257415 | A | 12/2013 |
| JP | 2014186194 | A | 10/2014 |
| JP | 2014-235394 | A | 12/2014 |
| WO | 2005/111730 | A1 | 11/2005 |

OTHER PUBLICATIONS

Notification of Reasons for Refusal dated Feb. 28, 2017 from corresponding Japanese Patent Application No. JP 2016-054521; English translation of Notification of Reasons for Refusal; Total of 10 pages.

* cited by examiner

*Primary Examiner* — Hoa V Le
(74) *Attorney, Agent, or Firm* — Lucas & Mercanti, LLP

(57) ABSTRACT

Provided is a means that can improve performance such as high-speed fixability and fixable temperature range while securing low temperature fixability, in an electrostatic charge image developing toner concurrently using a crystalline resin and an amorphous resin as binder resins constituting toner base particles.

An electrostatic charge image developing toner containing toner base particles containing an amorphous resin and a crystalline resin is constituted such that lamellar crystal structures and fibrous crystal structures are dispersed in the cross section of the toner base particles.

18 Claims, 1 Drawing Sheet

ELECTROSTATIC CHARGE IMAGE DEVELOPING TONER AND MANUFACTURING METHOD OF THE SAME

CROSS-REFERENCE TO RELATED APPLICATION

This application is based on Japanese Patent Application No. 2015-069992 filed on Mar. 30, 2015, the contents of which are incorporated herein by reference.

BACKGROUND

1. Technical Field

The present invention relates to an electrostatic charge image developing toner used in the electrophotographic image formation, and a method for manufacturing the same.

2. Description of Related Art

Conventionally, in an electrophotographic image forming method that forms visible image by an electrophotographic method, as a method for fixing toner image formed on a transfer medium such as a paper by an electrostatic charge image developing toner (hereinafter also simply referred to as a "toner"), a heat roller fixing system that fixes a transfer medium on which a toner image is formed, by passing between a heating roller and a pressing roller, is widely used. In order to secure fixability in this heat roller fixing system, namely, adhesion of toner on a transfer medium such as a paper, the heating roller requires high heat capacity.

However, recently, from the viewpoint of warming prevention measures of global environment, also to an electrophotographic image forming apparatus, request for energy saving is increased, thus, particularly in the electrophotographic image forming apparatus adopting a heat roller fixing system, many studies have been made for a technology for reducing a calorie required to fixation of a toner image, namely, low temperature fixing of toner, and the representative study includes those using a crystalline material.

For example, a technology that, in a toner containing a crystalline polyester resin and an amorphous resin, the crystalline polyester resin constituting toner base particles as fibrous crystal structures is contained, and the domain diameter is adjusted to promote further sharp meltability, and achieve sufficient low temperature fixability, is suggested (refer to JP 2013-257415 A). Also, a technology that a crystalline polyester resin is finely dispersed with an average diameter of 300 nm or less of a domain phase in a core part of toner particles with a three-layer structure is also suggested to make the crystalline polyester resin exist as a domain phase inside the core, to improve compatibility during thermal fixing, to further reduce the degree of crystallization, and consequently, variation in the degree of crystallinity is reduced, and high gloss uniformity is obtained in the obtained image (refer to JP 2014-186194 A). Furthermore, a technology to define the maximum domain diameter of the crystalline polyester resin present in the core part of toner, thereby suppressing filming while securing excellent low temperature fixability, is also suggested (refer to JP 2009-229920 A).

SUMMARY

As described above, low temperature fixability can be improved by controlling the crystal structure and domain diameter of the crystalline resin constituting the toner base particles. However, it was found that, based on the study of the present inventors, while the toner suggested by the conventional technology is improved in low temperature fixability, there are a problem that high-speed fixability is not sufficient (fixable linear velocity (process speed) is slow), and also a problem that the fixable temperature range is not sufficiently wide.

The present invention has been accomplished in view of the above circumstances, and an object thereof is to provide a means that can improve performance such as high-speed fixability and fixable temperature range while securing low temperature fixability, in an electrostatic charge image developing toner concurrently using a crystalline resin and an amorphous resin as binder resins constituting the toner base particles.

The present inventors have conducted intensive investigations in consideration of the above problem. As a result, they have found out that the above problem can be solved by constituting an electrostatic charge image developing toner containing toner base particles containing an amorphous resin and a crystalline resin, so that lamellar crystal structures and fibrous crystal structures are dispersed in the cross section of the toner base particles, thereby completing the present invention.

More specifically, according to an aspect of the present invention, an electrostatic charge image developing toner containing toner base particles containing an amorphous resin and a crystalline resin is provided. Moreover, the toner according to the present embodiment is characterized in that lamellar crystal structures and fibrous crystal structures are dispersed in the cross section of the toner base particles.

DETAILED DESCRIPTION

Figure 1:
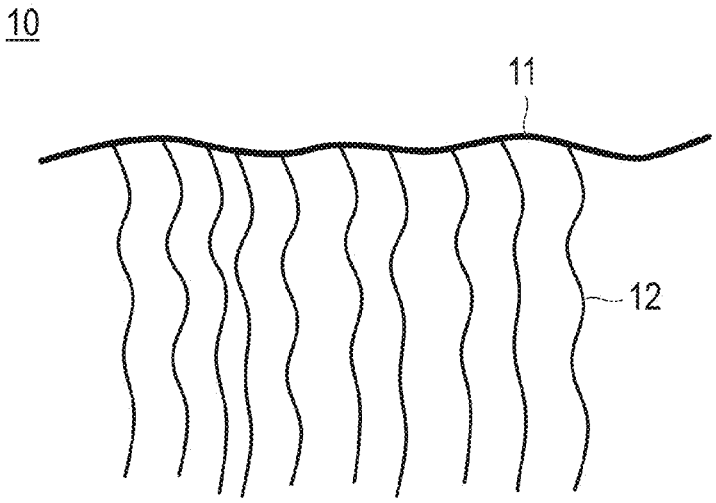
FIG. 1 is a schematic diagram showing a molecular structure of a hybrid crystalline polyester resin that is an example of a crystalline resin forming a lamellar structure.

Hereinafter, embodiments for carrying out the present invention will be described in detail.

<Toner>

The electrostatic charge image developing toner according to one aspect of the present invention contains toner base particles containing a crystalline resin and an amorphous resin. Here, it is characterized in that lamellar crystal structures and fibrous crystal structures are dispersed in the cross section of the toner base particles. According to the toner of the present invention having the constitution as described above, it is possible to improve performance such as high-speed fixability and fixable temperature range while securing low temperature fixability of the toner, and moreover, provide a toner also having excellent performance such as heat-resistant storage property and flowability of the toner. The mechanism for exhibiting such effects is not completely clear, and is presumed as follows.

Namely, in the toner base particles constituting the toner according to the present invention, it is considered that the size of the domain containing the crystalline resin inside the particles is controlled small, and moreover, the state in which the domain containing the crystalline resin inside the particles is uniformly dispersed can be realized. Accordingly, even when the heating time at the heat melting is instantaneous, it is considered that performance such as high-speed fixability and fixable temperature range can be improved while securing low temperature fixability, as described above, as a result of coexisting one among the crystalline resin that is quickly compatible with the amorphous resin and one in which itself is easily deformable even it is melted while keeping the shape of the crystal structure.

Hereinafter, components of the toner according to the present invention will be described in detail.

(Toner Base Particles)

The toner base particles according to the present invention contain a crystalline resin and an amorphous resin as binder resins. In addition, the toner base particles may contain other toner constituents such as a releasing agent, a colorant, a magnetic powder, and a charge control agent, as necessary. Also, the toner base particles according to the present invention are preferably obtained by a wet manufacturing method prepared in an aqueous medium (for example, an emulsion aggregation method, and the like).

<Binder Resins (Amorphous Resin and Crystalline Resin)>

The toner base particles according to the present invention contain a crystalline resin and an amorphous resin as binder resins.

Amorphous Resin

The amorphous resin is not particularly limited, and an amorphous resin conventionally known in the art can be used. Among them, the amorphous resin preferably contains an amorphous vinyl resin. When the amorphous resin contains a vinyl resin, a toner excellent in plasticity during thermal fixing can be provided. Here, the "vinyl resin" refers to a resin obtained by polymerization at least by using a vinyl monomer. Specific examples of the amorphous vinyl resin include acrylic resins, styrene-acrylic copolymer resins, and the like. Among them, the amorphous vinyl resin is preferably a styrene-acrylic copolymer resin formed by using a styrene monomer and a (meth)acrylic ester monomer.

As the vinyl monomer forming the amorphous vinyl resin, one or more kinds selected from the following can be used.

(1) Styrene Monomers

Styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene, derivatives thereof, etc.

(2) (Meth)Acrylic Ester Monomers

Methyl (meth)acrylate, ethyl (meth)acrylate, n-butyl (meth)acrylate, isopropyl (meth)acrylate, isobutyl (meth) acrylate, t-butyl (meth)acrylate, n-octyl (meth) acrylate, 2-ethylhexyl (meth) acrylate, stearyl (meth)acrylate, dodecyl (meth)acrylate, phenyl (meth) acrylate, diethylaminoethyl (meth) acrylate, dimethylaminoethyl (meth) acrylate, derivatives thereof, etc.

(3) Vinyl Esters

Vinyl propionate, vinyl acetate, vinyl benzoate, etc.

(4) Vinyl Ethers

Vinyl methyl ether, vinyl ethyl ether, etc.

(5) Vinyl Ketones

Vinyl methyl ketone, vinyl ethyl ketone, vinyl hexyl ketone, etc.

(6)N-Vinyl Compounds

N-Vinylcarbazole, N-vinylindole, N-vinylpyrrolidone, etc.

(7) Others

Vinyl compounds such as vinylnaphthalene and vinylpyridine, acrylic or methacrylic acid derivatives such as acrylonitrile, methacrylonitrile, acrylamide, etc.

Also, as the vinyl monomer, it is preferred to use, for example, a monomer having an ionic dissociation group such as a carboxy group, a sulfonate group or a phosphate group. Specific examples include the following.

The monomer having a carboxy group includes acrylic acid, methacrylic acid, maleic acid, itaconic acid, cinnamic acid, fumaric acid, maleic monoalkyl ester, itaconic monoalkyl ester, and the like. In addition, the monomer having a sulfonate group includes styrene sulfonic acid, allylsulfosuccinic acid, 2-acrylamido-2-methylpropanesulfonic acid, and the like. Furthermore, the monomer having a phosphate group includes acid phosphoxyethyl methacrylate, and the like.

Moreover, it is possible to form an amorphous vinyl resin having a crosslinked structure, by using polyfunctional vinyls as the vinyl monomer. The polyfunctional vinyls include divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate, and the like.

As the preferred form of the amorphous resin, the vinyl resin has been described in detail above, and an amorphous polyester resin and the like may be used as the amorphous resin.

The glass transition temperature (Tg) of the amorphous resin is preferably from 25 to 60° C., and more preferably from 35 to 55° C. When the amorphous resin has a glass transition temperature within the aforementioned range, both sufficient low temperature fixability and heat-resistant storage property are obtained. The glass transition temperature (Tg) of the amorphous resin is a value which is measured using "DIAMOND DSC" (manufactured by Perkin Elmer, Co., Ltd). Measurement order is as follows, 3.0 mg of a measurement sample (amorphous resin) is sealed in an aluminum pan and set in a holder. An empty aluminum pan was used as a reference. Measurement conditions are as follows. The temperature is controlled through heating-cooling-heating at a temperature increase rate of 10° C./min and a temperature-lowering rate of 10° C./min in the measurement temperature of 0 to 200° C. Analysis is made based on the data from the second heating, and an extension line from the base-line prior to the rise of the first endothermic peak and a tangent line exhibiting the maximum slope between the initial rise and the peak of the first endothermic peak are drawn, and the intersection of both lines is defined as the glass transition temperature.

In addition, the amorphous resin preferably has a molecular weight of 10,000 to 100,000, in terms of weight average molecular weight (Mw) as measured by gel permeation chromatography (GPC). In the present invention, the molecular weight of the amorphous resin by GPC is a value measured as described later. Specifically, using an apparatus "HLC-8120GPC" (manufactured by TOSOH CORPORATION) and a column "TSK guard column+TSK gel Super HZ-M3 series" (manufactured by TOSOH CORPORATION), tetrahydrofuran (THF) is used as a carrier solvent at a flow rate of 0.2 mL/min while maintaining the column temperature at 40° C., a measurement sample (amorphous resin) is dissolved in tetrahydrofuran to have a concentration of 1 mg/ml under dissolving conditions including 5-minute treatment using an ultrasonic disperser at room temperature, a sample solution is obtained subsequently by treating with a membrane filter with a pore size of 0.2 μm, 10 μL of the sample solution is injected to the device together with the carrier solvent, the detection is made by using a refractive index detector (RI detector), and molecular weight distribution of the measurement sample is calculated using a calibration curve determined by using mono-dispersed polystyrene reference particles. Ten points are used as the polystyrene for determining a calibration curve.

Crystalline Resin

The crystalline resin is not also particularly limited, and a crystalline resin conventionally known in the art can be used. Among them, the crystalline resin preferably contains a crystalline polyester resin. Here, the "crystalline polyester resin" refers to a resin that, among known polyester resins obtained by a polycondensation reaction of at least divalent carboxylic acid (polyvalent carboxylic acid) and at least divalent alcohol (polyhydric alcohol), has no step-wise endothermic change in differential scanning calorimetry (DSC) but has a clear endothermic peak. The clear endothermic peak specifically means a peak that has 15° C. or less half-width of the endothermic peak when measured at 10° C./min of the temperature increase rate in the differential scanning calorimetry (DSC).

The polyvalent carboxylic acid is a compound containing two or more carboxy groups in one molecule. Specific examples include saturated aliphatic dicarboxylic acids such as oxalic acid, malonic acid, succinic acid, adipic acid, sebacic acid, azelaic acid, n-dodecyl succinic acid, nonane dicarboxylic acid, decane dicarboxylic acid, undecane dicarboxylic acid, dodecane dicarboxylic acid (dodecanedioic acid), and tetradecane dicarboxylic acid (tetradecanedioic acid); alicyclic dicarboxylic acids such as cyclohexanedicarboxylic acid; aromatic dicarboxylic acids such as phthalic acid, isophthalic acid and terephthalic acid; trivalent or more polyvalent carboxylic acids such as trimellitic acid and pyromellitic acid; and anhydrides or alkyl esters having 1 to 3 carbon atoms of these carboxylic acids; and the like. One kind of these compounds may be used solely, or two or more kinds of them may be used by being combined with each other.

The polyhydric alcohol is a compound containing two or more hydroxyl groups in one molecule. Specific examples include aliphatic diols such as 1,2-propanediol, 1,3-propanediol, 1,4-butanediol, 1,5-pentanediol, 1,6-hexanediol, 1,7-heptanediol, 1,8-octanediol, 1,9-nonanediol, dodecanediol, neopentyl glycol and 1,4-butenediol; trivalent or more polyhydric alcohols such as glycerol, pentaerythritol, trimethylolpropane and sorbitol; and the like. One kind of these compounds may be used solely, or two or more kinds of them may be used by being combined with each other.

The crystalline polyester resin (a hybrid crystalline polyester resin and a non-hybrid crystalline polyester resin described later) has a melting point (Tm) of preferably 55 to 90° C., and more preferably 70 to 85° C. When the crystalline polyester resin has a melting point within the aforementioned range, sufficient low temperature fixability and excellent hot-offset resistance are obtained. Here, the melting point of the crystalline polyester resin can be controlled by resin composition.

In the present invention, the melting point of the crystalline polyester resin is a value which is measured as described later. Specifically, the melting point is measured in the measurement conditions (temperature increasing and cooling conditions) that go through the order of a first temperature increasing process in which the temperature is increased from 0° C. to 200° C. at a temperature increase rate of 10° C./min, a cooling process in which the temperature is decreased from 200° C. to 0° C. at a cooling rate of 10° C./min, and a second temperature increasing process in which the temperature is increased from 0° C. to 200° C. at a temperature increase rate of 10° C./min, using a differential scanning calorimeter "DIAMOND DSC" (manufactured by Perkin Elmer, Co., Ltd). Based on the DSC curve obtained by this measurement, the endothermic peak top temperature derived from the crystalline polyester resin in the first temperature increasing process is defined as a melting point (Tm). Measurement order is as follows. 3.0 mg of a measurement sample (crystalline polyester resin) is sealed in an aluminum pan and set in a sample holder of "DIAMOND DSC". An empty aluminum pan is used as a reference.

The crystalline polyester resin preferably has a weight average molecular weight (Mw) of 5,000 to 50,000 and a number average molecular weight (Mn) of 1,500 to 25,000, as molecular weights measured by gel permeation chromatography (GPC). The molecular weight measured by GPC of the crystalline polyester resin is measured in the same manner as described above, except for using the crystalline polyester resin as the measurement sample.

The mass ratio of the amorphous resin and the crystalline resin (amorphous resin/crystalline resin) is preferably 97/3 to 70/30, and more preferably 95/5 to 75/25. When the mass ratio (amorphous resin/crystalline resin) is in the above range, the crystalline resin is not exposed on the surface of the toner particles to be formed, or the amount is very small even it exposes, and the crystalline resin in an amount that can secure low temperature fixability can be introduced into the toner particles.

The crystalline resin preferably contains a crystalline resin formed by chemical bonding of a vinyl polymerization segment and a polyester polymerization segment (hereinafter, the crystalline resin having such a plurality of segments is also simply referred to as "hybrid crystalline resin", and a crystalline resin without having said plurality of segments is also simply referred to as "non-hybrid crystalline resin".) At this time, the vinyl polymerization segment and the polyester polymerization segment are preferably a crystalline resin bonded via a bireactive monomer. Here, the polyester polymerization segment is constituted by a crystalline polyester resin. When the crystalline resin contains a hybrid crystalline resin, the thickness by folding of the molecular chain of a lamellar crystal structure can be increased to some extent (namely, crystallinity can be increased), and, thus, the molecular chain becomes easier to align at the time o crystallization. As a result, the lamellar crystal structure can be easily formed. This is thought to be attributable to that, because a vinyl polymerization segment introduced into the hybrid crystalline resin has high affinity with an amorphous resin, the hybrid crystalline resin has affinity to the amorphous resin (easily fixed), and consequently, the molecular chain of the crystalline resin becomes easy to align.

Vinyl Polymerization Segment

The vinyl polymerization segment constituting the hybrid crystalline resin is constituted by a resin obtained by polymerizing vinyl monomers. Here, as the vinyl monomer, one described above as the monomer constituting a vinyl resin can be used in the same manner, thus the detailed description is omitted. The content of the vinyl polymerization segment in the hybrid crystalline resin (hybridization rate ("HB rate" described in the Examples described later) is not particularly limited, but when the hybrid crystalline resin is used together with a non-hybrid crystalline resin, the hybridization rate of the hybrid crystalline resin is more preferably in the range of 5 to 30% by mass, further preferably in the range of 5 to 20% by mass, and particularly preferably in the range of 5 to 10% by mass. Also, when the hybrid crystalline resin is not used together with a non-hybrid crystalline resin, the hybridization rate of the hybrid crystalline resin is preferably 40% by mass or more, more preferably in the range of 40 to 60% by mass, and further preferably in the range of 45 to 50% by mass. When the hybridization rate in the hybrid crystalline resin is in this range, there is an advantage that a lamellar crystal structure and a fibrous crystal structure that are characteristic constitutions of the toner according to the present invention easily coexist. Crystalline segment portions originally gather in the hybrid crystalline resin, as compared to in the non-hybrid crystalline resin, thus the crystalline segment portions are easily uniformly arranged in crystallization, and the crystal structure easily appears in a lamellar form. Among the hybrid crystalline resins, one having a comb-shaped hybrid structure shown in FIG. 1 described later is likely to have a particularly fine crystalline arrangement, and is likely to have a lamellar crystal structure. On the other hand, in a non-hybrid crystalline resin, the crystalline segment portions do not gather as in the hybrid crystalline resin, thus each crystalline segment portion forms a crystal structure in crystallization. Therefore, a layer structure is not likely to be formed, and it tends to appear as a monomer crystal structure such as a fibrous substance.

Polyester Polymerization Segment

The polyester polymerization segment constituting a hybrid crystalline resin is constituted by a crystalline polyester resin manufactured by a polycondensation reaction of a polyvalent carboxylic acid and a polyhydric alcohol, in the presence of a catalyst. Here, specific kinds of the polyvalent carboxylic acid and the polyhydric alcohol are as described above, thus the detailed description is omitted.

Bireactive Monomer

The "bireactive monomer" refers to a monomer combining a polyester polymerization segment and a vinyl polymerization segment, and is a monomer having both a group selected from a hydroxy group, a carboxy group, an epoxy group, a primary amino group and a secondary amino group that forms the polyester polymerization segment, and an ethylenically unsaturated group that forms the vinyl polymerization segment, in the molecule. The bireactive monomer is preferably a monomer having a hydroxy group or carboxy group and an ethylenically unsaturated group, and further preferably a monomer having a carboxy group and an ethylenically unsaturated group. Specifically, the bireactive monomer is preferably a vinyl-based carboxylic acid.

Specific examples of the bireactive monomer include acrylic acid, methacrylic acid, fumaric acid, maleic acid and the like, and may also be a hydroxylalkyl (carbon number of 1 to 3) ester thereof. From the viewpoint of reactivity, acrylic acid, methacrylic acid, and fumaric acid are preferable. The polyester polymerization segment and the vinyl polymerization segment are combined via this bireactive monomer.

The use amount of the bireactive monomer is, from the viewpoint of improving low temperature fixability, high-temperature offset resistance and durability of the toner, preferably 1 to 10 parts by mass and more preferably 4 to 8 parts by mass, based on 100 parts by mass of the total amount of the vinyl monomers constituting the vinyl polymerization segment.

Method for Manufacturing Hybrid Crystalline Resin

An existing general scheme can be used as a method for manufacturing a hybrid crystalline resin. A representative method includes the following three methods.

(1) A method for forming a hybrid crystalline resin by polymerizing a polyester polymerization segment in advance, reacting a bireactive monomer with the polyester polymerization segment, and further reacting an aromatic vinyl monomer and a (meth)acrylic ester monomer for forming a vinyl polymerization segment with it.

(2) A method for forming a polyester polymerization segment by polymerizing a vinyl polymerization segment in advance, reacting a bireactive monomer with the vinyl polymerization segment, and further reacting a polyvalent carboxylic acid and a polyhydric alcohol for forming a polyester polymerization segment with it.

(3) A method for combining a polyester polymerization segment and a vinyl polymerization segment by polymerizing both segments in advance, and reacting a bireactive monomer with these segments.

In the present invention, any method among the above manufacturing methods can be used, but a method of the above item (2) is preferred. Specifically, it is preferred to mix a polyvalent carboxylic acid and a polyhydric alcohol for forming a polyester polymerization segment, and a vinyl monomer for forming a vinyl polymerization segment and a bireactive monomer, add a polymerization initiator to addition-polymerize the vinyl monomer and the bireactive monomer to form a vinyl polymerization segment, and then add an esterification catalyst to perform a polycondensation reaction.

Here, as a catalyst for synthesizing a polyester polymerization segment, various conventionally known catalysts can be used. Also, the esterification catalyst includes tin compounds such as dibutyltin oxide and tin(II) 2-ethylhexanoate, titanium compounds such as titanium diisopropoxybistriethanolaminate, and the like, and the esterification cocatalyst includes gallic acid and the like.

Existing Form of Crystalline Resin

In the toner according to the present invention, it is one of the characteristics that lamellar crystal structures and fibrous crystal structures constituted by a crystalline resin are dispersed in the cross section of the toner base particles. Here, the "lamellar crystal structure" means a layered structure produced by crystallization by folding of the molecular chain of a crystalline resin. Also, the "fibrous crystal structure" is a crystal structure formed without crystallization by folding of the molecular chain of a crystalline resin, and means a fibrous crystal structure constituted by one or several molecular chains. Here, FIG. 1 is a schematic diagram showing a molecular structure of a hybrid crystalline polyester resin that is an example of a crystalline resin forming a lamellar structure. The hybrid crystalline polyester resin 10 shown in FIG. 1 has a chemically bonded structure of a styrene-acrylic resin segment (vinyl polymerization segment) 11 that is a main chain and a crystalline polyester resin segment (polyester polymerization segment) 12 as a side chain. As a result, as shown in FIG. 1, the hybrid crystalline polyester resin 10 has a comb-shaped molecular structure. Such comb-shaped molecular structure constitutes a lamellar crystal structure by being folded and crystallized, for example, in a resin different from a polyester resin.

In the present invention, in order to confirm the presence or absence of lamellar crystal structures and fibrous crystal structures in the cross section of the toner base particles, the toner is stained by ruthenium staining, then the cross section of the toner particles is observed using a transmission electron microscope (TEM). In more detail, the methods and conditions in the Examples described later are used.

Figure 2:
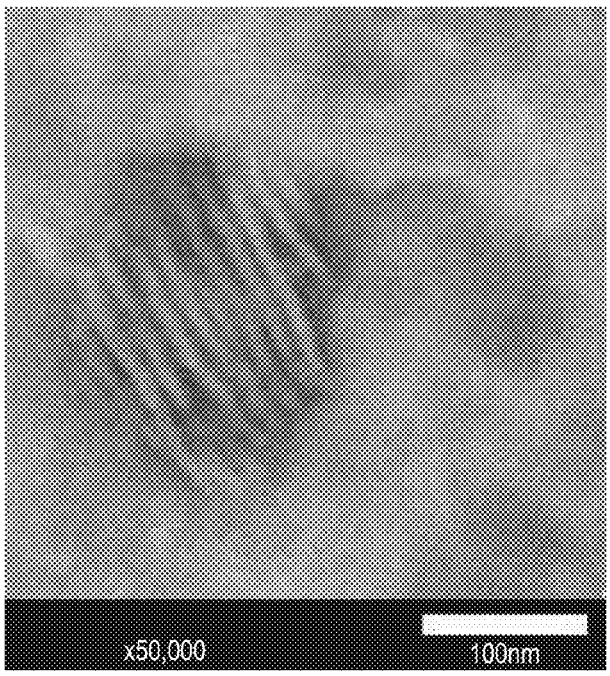
FIG. 2 is a photograph of a toner prepared by using a hybrid crystalline polyester resin having a lamellar crystal structure that is subjected to ruthenium staining, then observed using a TEM (transmission electron microscope) (magnification: 50,000 times).

FIG. 2 is a photograph of a toner prepared using a hybrid crystalline polyester resin having a lamellar crystal structure that is subjected to ruthenium staining, then observed using a TEM (transmission electron microscope) (magnification: 50,000 times). As shown in FIG. 2, in the domain consisting of the crystalline resin, crystalline polyester resin segments (polyester polymerization segment) combined in a comb shape form lamellar crystal structures.

In the toner according to the present invention, in the cross section of the toner base particles, the size of the lamellar crystal structure is not particularly limited, but the average domain diameter of the lamellar crystal structures is preferably 0.1 to 2 μm, and more preferably 0.6 to 2 μm. Similarly, the size of the fibrous crystal structure is not also particularly limited, but the domain diameter of the fibrous crystal structures is preferably 2 μm or less and more preferably 0.2 to 1 μm in major diameter (average), and the domain diameter of the fibrous crystal structures is preferably 0.01 to 1 μm and more preferably 0.01 to 0.5 μm in minor diameter (average). When the size of each crystal structure is a value within the above ranges, it is possible to obtain both sufficient low temperature fixability and high-speed fixability, and further, it is also possible to control fixable temperature range. In addition, deterioration of storage property, chargeability and flowability and image quality defect can be suppressed by controlling exposure of the toner surface, thus it is preferred. Here, the method for measuring the size of a lamellar crystal structure and a fibrous crystal structure are as described in the Examples described later. In the present invention, when observing 100 toner base particles by the above method, in the cross section, the toner base particles satisfying the above specification should be present in 60% (60 particles) or more, and is preferably present in 80% (80 particles) or more of the entire toner base particles. When the toner base particles satisfying the above specification (coexistence of the lamellar crystal structures and the fibrous crystal structures) occupy 60% or more of the entire toner base particles, improvement of various performance such as low temperature fixability, high-speed fixability, fixable temperature range, heat-resistant storage property and flowability, that is the desired effect of the present invention is achieved.

In the cross section of the toner base particles, the existing position of the lamellar crystal structure and the fibrous crystal structure is not particularly limited, it is preferred that the lamellar crystal structure is not present in a predetermined region of the toner base particles, namely, the region shallower than 0.1 times of the particle size (the volume-based median diameter) of the toner base particles in depth. In other words, a preferred embodiment of the toner according to the present invention is a form in which the lamellar crystal structures are present in the region 0.1 times or more of the particle size of the toner base particles in depth from the surface of the toner base particles, and the fibrous crystal structures are dispersed over the entire toner base particles. Also, from the viewpoint of further improving heat-resistant storage property and flowability of the toner, it is a more preferred embodiment in which both of the lamellar crystal structures and the fibrous crystal structures are not present in the predetermined region of the toner base particles (namely, both of these structures are present only in the region 0.1 times or more of the particle size of the toner base particles in depth from the surface of the toner base particles). Here, the existing position of each crystal structure can be confirmed by a procedure described in the Examples described later.

Moreover, the ratio of the total cross-sectional area of the lamellar crystal structures and the fibrous crystal structures to the cross-sectional area of the toner base particles is preferably 1 to 50%, more preferably 1 to 30%, and further preferably 5 to 20%. When the value of the ratio of the total cross-sectional area is a value within the above ranges, it is possible to obtain both sufficient low temperature fixability and high-speed fixability, and further, it is also possible to control fixable temperature range. Here, the ratio of the total cross-sectional area can also be measured by a procedure described in the Examples described later.

<Releasing Agent (Offset Inhibitor)>

When the toner of the present invention is constituted so that the toner base particles contain a releasing agent, the releasing agent may be contained in either a matrix phase (amorphous resin phase) or a domain phase (crystalline resin phase), and it is particularly preferred to be contained in the matrix phase (amorphous resin phase), from the viewpoint of oozing of the releasing agent on the surface during fixing.

As a wax, particularly, a polyolefin wax such as a low molecular weight polypropylene or polyethylene, or an oxidation type polypropylene or polyethylene, or an ester-based wax such as behenyl behenate can be preferably used.

Specific examples include polyolefin waxes such as polyethylene wax and polypropylene wax; branched-chain type hydrocarbon waxes such as microcrystalline wax; long chain hydrocarbon waxes such as paraffin wax and sasol wax; dialkyl ketone-based waxes such as distearyl ketone; ester-based waxes such as carnauba wax, montan wax, behenyl behenate, trimethylolpropane tribehenate, pentaerythritol tetrabehenate, pentaerythritol diacetate dibehenate, glycerin tribehenate, 1,18-octadecane diol distearate, tristearyl trimellitate, and distearyl maleate; amide-based waxes such as ethylene diamine behenylamide and tristearylamide trimellitate; and the like.

Among them, a wax having a low melting point, specifically, a melting point of 40 to 90° C., is preferably used, from the viewpoint of releasability during low temperature fixing. The content ratio of the releasing agent is preferably 1 to 20% by mass and more preferably 5 to 20% by mass, in the toner base particles.

<Colorants>

When the toner of the present invention is constituted so that the toner base particles contain a colorant, the colorant may be contained in either a matrix phase (amorphous resin phase) or a domain phase (crystalline resin phase), and it is particularly preferred to be contained in the matrix phase (amorphous resin phase), from the viewpoint of dispersibility of the colorant. Carbon blacks, black iron oxides, dyes and pigments can be used as a colorant.

Examples of carbon black include channel black, furnace black, acetylene black, thermal black, lamp black, and the like, and examples of black iron oxide include magnetite, hematite, titanium trioxide, and the like.

Examples of dye include C.I. Solvent Red 1, 49, 52, 58, 63, 111, and 122, C.I. Solvent Yellow 19, 44, 77, 79, 81, 82, 93, 98, 103, 104, 112, and 162, C.I. Solvent Blue 25, 36, 60, 70, 93, and 95, and the like.

Examples of pigments include C.I. Pigment Red 5, 48:1, 48:3, 53:1, 57:1, 81:4, 122, 139, 144, 149, 150, 166, 177, 178, 222, 238, and 269, C.I. Pigment Orange 31, and 43, C.I. Pigment Yellow 14, 17, 74, 93, 94, 138, 155, 156, 158, 180, and 185, C.I. Pigment Green 7, C.I. Pigment Blue 15:3, and 60, and the like.

Colorants for obtaining a toner of each color can be used solely or in their combination of two kinds or more for each color. The content ratio of the colorant is preferably 1 to 10% by mass and more preferably 2 to 8% by mass, in the toner base particles.

<Charge Control Agent>

When the toner of the present invention is constituted so that the toner base particles contain a charge control agent, the charge control agent may be contained in either a matrix phase (amorphous resin phase) or a domain phase (crystalline resin phase), and it is particularly preferred to be contained in the matrix phase (amorphous resin phase), from the viewpoint of dispersibility of the charge control agent.

The content ratio of the charge control agent is usually 0.1 to 10 parts by mass and preferably 0.5 to 5 parts by mass, based on 100 parts by mass of the binder resin finally obtained.

(External Additive Particles)

The toner according to the present invention may contain external additive particles, in addition to the toner base particles. As external additive particles, conventionally known external additive particles can be used. Examples of external additive particles include inorganic oxide fine particles composed of silica fine particles, alumina fine particles, titania fine particles and the like, inorganic stearic acid compound fine particles such as aluminum stearate fine particles and zinc stearate fine particles, inorganic titanic acid compound fine particles such as strontium titanate and zinc titanate, and the like. These compounds can be used solely, or in their combination of two kinds or more. These inorganic fine particles are preferably gloss-treated with a silane coupling agent or titanium coupling agent, a higher fatty acid, a silicone oil or the like, for the improvement of heat-resistant storage property and the improvement of environmental stability.

(Glass Transition Temperature of Toner)

The glass transition temperature (Tg) of the toner according to the present invention is preferably from 25 to 65° C., and more preferably from 35 to 55° C. When the toner of the present invention has a glass transition temperature within the aforementioned range, both sufficient low temperature fixability and heat-resistant storage property are obtained. The glass transition temperature of the toner is measured in the same manner as described above, except for using the toner as the measurement sample.

(Particle Diameter of Toner)

The average particle diameter of the toner according to the present invention is, for example, preferably 3 to 8 μm, and more preferably 5 to 8 μm, in terms of a volume-based median diameter. The average particle diameter can be controlled based on the concentration of an aggregating agent or addition amount of an organic solvent used during manufacturing, time for fusion, composition of a binder resin, or the like. When the volume-based median diameter falls within the aforementioned range, a very minute dot image at a level of 1200 dpi can be faithfully reproduced. The volume-based median diameter of the toner is measured and calculated by using a device for measurement in which a computer system equipped with a software for data processing "Software V3.51" is connected to "Multisizer 3" (manufactured by Beckman Coulter, Inc). Specifically, 0.02 g of a measurement sample (toner) is added to 20 mL of a surfactant solution (in which, for example, a neutral detergent containing a surfactant component is diluted 10 times with pure water for the purpose of dispersing toner particles) followed by fusion, and then subjected to ultrasonic dispersion for 1 minute to prepare a toner dispersion. The toner dispersion is injected by a pipette into a beaker containing "ISOTON II" (manufactured by Beckman Coulter, Inc.) placed in a sample stand until it reaches a display concentration of 8% by the device for measurement. Such a concentration range makes it possible to obtain reproducible measurement values. Further, with regard to the device for measurement, the counting number for particles for measurement is set to 25000 particles and an aperture diameter of 100 μm is used. A measurement range of 2 to 60 μm is divided to 256 parts and the frequency of an individual part is calculated and the particle diameter at 50% of volume fraction integrated from the larger side is defined as the volume-based median diameter.

(Average Circularity of Toner)

With regard to the toner according to the present invention, the average circularity of each individual toner particle which constitutes the toner is preferably 0.930 to 1.000, and more preferably 0.950 to 0.995, from the viewpoint of stability of charge characteristics and low temperature fixability. When the average circularity falls within the aforementioned range, it is difficult for each individual toner particle to be broken, and thus contamination of a member for having frictional electrification is suppressed. Accordingly, chargeability of the toner is stabilized, and high image quality is obtained for an image to be formed. The average circularity of the toner is a value measured by using "FPIA-2100" (manufactured by Sysmex Corporation). Specifically, a measurement sample (toner) is fused in an aqueous solution added with a surfactant and dispersed for 1 minute by an ultrasonic dispersion treatment. Thereafter, using "FPIA-2100" (manufactured by Sysmex Corporation), in the measurement condition of HPF (high power field) mode, the image is taken at an optimum concentration including the HPF detection number of 3,000 to 10,000. The circularity is calculated for each toner particle according to the following formula, and the added circularity of each toner particle is divided by the total number of the toner particles. When the HPF detection number falls within the aforementioned range, the reproducibility is obtained.

Circularity=(Circumference length of a circle having an equivalent projection area of a particle image)/(Circumference length of a projection image of a particle)

<Method for Manufacturing Toner>

<Method for Manufacturing Toner Base Particles>

The toner base particles according to the present invention can be manufactured, for example, by an emulsion aggregation method. When the toner base particles according to the present invention is manufactured by an emulsion aggregation method, the manufacturing method includes, for example, adding a dispersion liquid (a) containing amorphous resin fine particles and a dispersion liquid (b) containing crystalline resin fine particles to an aqueous medium to prepare a mixed dispersion liquid and increasing the temperature of the mixed dispersion liquid to aggregate the amorphous resin fine particles and the crystalline resin fine particles to form toner base particles. The "aqueous medium" herein refers to a medium which includes at least 50% by mass of water, and component other than water includes organic solvents which can dissolve in water. Examples include methanol, ethanol, isopropanol, butanol, acetone, methyl ethyl ketone, dimethylformamide, methyl cellosolve, tetrahydrofuran, and the like. Among them, an alcoholic organic solvent like methanol, ethanol, isopropanol or butanol, which is an organic solvent not dissolving a resin is preferably used. Preferably, only water is used as an aqueous medium.

For example, the above-described manufacturing method can be constituted as one including each step below. Here, the following example is described for a case where amorphous resin fine particles contain a releasing agent, crystalline resin fine particles are crystalline polyester resin fine particles, and toner base particles contain a colorant, and the technical scope of the present invention is not limited to these embodiments.

(1) A preparation step of a dispersion liquid (a) in which a dispersion liquid (a) containing amorphous resin fine particles containing a releasing agent is prepared;

(2) a preparation step of a dispersion liquid (b) in which a crystalline polyester resin is dissolved in an organic solvent, emulsified and dispersed in an aqueous dispersion medium, and the organic solvent is removed to prepare a dispersion liquid (b) containing crystalline polyester resin fine particles;

(3) a preparation step of a mixed dispersion liquid in which the dispersion liquid (a) prepared in the above (1) and the dispersion liquid (b) prepared in the above (2) are added to an aqueous medium to prepare a mixed dispersion liquid;

(4) an aggregated particles formation step in which the temperature of the mixed dispersion liquid prepared in the (3) is increased to aggregate the amorphous resin fine particles and the crystalline resin fine particles to form toner base particles;

(5) an aging step in which the aggregated particles formed in the (4) are aged by thermal energy to control the shape to obtain toner base particles;

(6) a cooling step of cooling a dispersion liquid of the toner base particles;

(7) a filtering and washing step in which the toner base particles are filtered from the aqueous medium, and a surfactant and the like are removed from the toner base particles; and (8) a drying step in which the washed toner base particles are dried.

As described above, the toner base particles according to the present invention can include those including the necessary steps of (1) to (4), and steps of (5) to (8) that can be added as necessary.

When each step described above is performed, a conventionally known knowledge can be properly referred to. For example, the dispersion liquid (a) containing amorphous resin fine particles and dispersion liquid (b) containing crystalline resin fine particles described above can be prepared using various emulsification methods such as a method of emulsifying by mechanical shear force, and are preferably prepared by using a procedure called as a phase inversion emulsification method. Particularly, when the dispersion liquid (b) is prepared using a phase inversion emulsification method, an oil droplet can be uniformly dispersed by changing stability of a carboxyl group of polyester, and it is excellent in that the oil droplet is not forced to disperse by shear force as in a mechanical emulsification method. In the "phase inversion emulsification method", a dispersion liquid of the resin fine particles is obtained by undergoing a dissolution step of dissolving a resin in an organic solvent to obtain a resin solution, a neutralization step of charging a neutralizing agent into the resin solution, and emulsification step of emulsifying and dispersing the neutralized resin solution in an aqueous dispersion medium to obtain a resin emulsion, and a desolvation step of removing the organic solvent from the resin emulsion. Here, the particle diameter of the resin fine particles in the dispersion liquid can be controlled by changing the added amount of the neutralizing agent.

Here, as a method for realizing the constitution that the "lamellar crystal structures and fibrous crystal structures are dispersed in the cross section of the toner base particles" characterized in the present invention described above, for example, a method using both the hybrid crystalline resin and the non-hybrid crystalline resin as the crystalline resin used in the (2) of the manufacturing method described above is exemplified (Examples 1 to 10 described later). In addition, as another method for realizing the constitution, a method using only the hybrid crystalline resin which has a hybridization rate of the hybrid crystalline resin of 40% by mass or more as the crystalline resin used in the (2) of the manufacturing method described above is also exemplified (Example 11 described later). By adopting these methods, when a non-hybrid crystalline resin is used together with a hybrid crystalline resin, the hybrid crystalline resin tends to have a lamellar crystal structure, and on the other hand, the non-hybrid crystalline resin tends to have a fibrous crystal structure, thus the constitution is easily realized. Also, even when a non-hybrid crystalline resin is not used together with a hybrid crystalline resin, the hybrid crystalline resin is not likely to have a lamellar crystal structure having high crystallinity and is likely to have a fibrous crystal structure by using one having relatively high hybridization rate as the hybrid crystalline resin, and consequently, the constitution is also easily realized.

Moreover, toner base particles having a core shell structure can also be formed by using the above-mentioned toner base particles as a core and providing a shell layer on its surface. By having a core shell structure, heat-resistant storage property and low temperature fixability can be further improved. In order to manufacture the toner base particles of a core shell structure, for example, in the manufacturing method described above, after the aggregated particles formation step of the (4), the following step:

(4') a step of adding a dispersion liquid for a shell (c) containing amorphous resin fine particles to the mixed dispersion liquid to form a shell on the surface of the core particles, using the toner base particles prepared in the (4) as core particles, is carried out, and subsequently the steps on and after the (5) should be carried out.

<Method for Manufacturing Toner Particles>

(Step for Adding External Additive)

The step for adding an external additive is a step for adding and mixing dried toner base particles with external additive particles to prepare toner particles. The method for adding an external additive includes a dry method of adding an external additive in a powder form to the dried toner base particles, and the mixing device includes mechanical mixing devices such as a Henschel mixer and a coffee mill.

<Electrostatic Charge Image Developing Developer>

The toner according to the present invention can be used as a magnetic or non-magnetic one-component developer and also may be used as a two-component developer by being mixed with a carrier. When the toner is used as a two-component developer, magnetic particles made of conventionally known material such as a metal such as iron, ferrite or magnetite, an alloy of the foregoing metal and a metal of aluminum or lead can be used as a carrier, and a ferrite particle is particularly preferred. Also, as a carrier, a coated carrier prepared by coating the surface of magnetic particles with a coating agent such as a resin, and a dispersion carrier prepared by dispersing magnetic fine powder in a binder resin.

The volume-based median diameter of the carrier is preferably from 20 to 100 μm, and further preferably from 25 to 80 μm. The volume-based median diameter of the carrier can be representatively measured by a laser diffraction type particle size distribution meter "HELOS" (manufactured by SYMPATEC Co).

The "toner" according to the present invention contains "toner base particles" as described above. The "toner base particles" is called as "toner particles" by the addition of external additive particles. Moreover, the "toner" refers to an aggregate of the "toner particles".

<Electrophotographic Image Forming Method>

The electrostatic charge image developing developer according to the present invention can be used in various known electrophotographic image forming methods. For example, it can be used in a monochrome image forming method or a full color image forming method. Any image forming method can be used in the method for forming a full-color image. They are a four-cycle type image forming method constituted by four kinds of color developing devices according to each of yellow, magenta, cyan, and black colors and one electrostatic charge image carrier (also referred to as "electrophotographic photoreceptor" or simply "photoreceptor"), a tandem type image forming method using image forming units for the colors each having a color developing device and an electrostatic charge image carrier for each color, and the like.

As an electrophotographic image forming method, specifically, using the electrostatic charge image developing developer according to the present invention, for example, an image is charged on an electrostatic charge image carrier using a charging device (charging step), an electrostatic charge image is electrostatically formed by image-exposure (exposing step), and the toner is charged by a carrier in the electrostatic charge image developing developer according to the present invention in a developing device, thereby obtaining a toner image by development (developing step). Moreover, the toner image is transferred to a paper sheet (transferring step), and then the toner image transferred to the paper sheet is fixed on the paper sheet by a contact-heating fixing treatment (fixing step), thereby obtaining a visible image.

EXAMPLES

The effect of the present invention will be described using the following Examples and Comparative Examples. In the following Examples, the terms "part" and "%" mean "part by mass" and "mass %", respectively, unless otherwise noted, and each operation is carried out at room temperature (25° C.). The present invention is not limited to the following examples.

<Preparation of Toner>

Manufacturing Example 1

Synthesis of Hybrid Crystalline Polyester Resin (1)

Raw material monomers of an addition polymerization resin (styrene-acrylic resin: StAc1) segment of the composition shown below, including a bireactive monomer, and a radical polymerization initiator were added to a dropping funnel.

Styrene 34 parts by mass n-Butyl acrylate 12 parts by mass

Acrylic acid 2 parts by mass

Polymerization initiator (di-t-butylperoxide) 7 parts by mass

Also, raw material monomers of the following polycondensation resin (crystalline polyester resin: CPEs1) segment were charged to a four-neck flask equipped with a nitrogen introducing tube, a dewatering tube, a stirrer, and a thermocouple, and dissolved by heating to 170° C.

Tetradecanedioic acid 271 parts by mass 1,6-Hexanediol 118 parts by mass

Subsequently, the raw material monomers of the addition polymerization resin (StAc1) were added dropwise over 90 minutes while stirring the contents of the flask, and the mixture was aged for 60 minutes, then the raw material monomers of unreacted addition polymerization resin were removed under reduced pressure (8 kPa). The monomer amount removed at that time was a very small amount with respect to the raw material monomer ratio of the resin.

Thereafter, 0.8 parts by mass of $Ti(OBu)_4$ was charged as an esterification catalyst, and the temperature was increased to 235° C., then the reaction was performed under normal pressure (101.3 kPa) for 5 hours and further under reduced pressure (8 kPa) for 1 hour.

Next, the reactant was cooled to 200° C., and then reacted under reduced pressure (20 kPa) for 1 hour to obtain a hybrid crystalline polyester resin (1). The content of a resin segment other than CPEs (StAc1) based on 100% by mass of the total amount of the hybrid crystalline polyester resin (1) (HB rate) was 10% by mass, and the hybrid crystalline polyester resin (1) was a resin in a form in which the CPEs segment was grafted to the StAc segment. Also, the hybrid crystalline polyester resin (1) had a number average molecular weight (Mn) of 6400 and a melting point (Tc) of 75.2° C.

Manufacturing Example 2

Synthesis of Hybrid Crystalline Polyester Resin (2)

The same procedures were carried out as in the Manufacturing Example 1, except for using raw material monomers of an addition polymerization resin (styrene-acrylic resin: StAc2) segment of the composition shown below and a radical polymerization initiator to obtain a hybrid crystalline polyester resin (2). The number average molecular weight (Mn) of the hybrid crystalline polyester resin (2) is shown in Table 1 below.

Styrene 32 parts by mass n-Butyl acrylate 11 parts by mass

Acrylic acid 5 parts by mass

Polymerization initiator (di-t-butylperoxide) 7 parts by mass

Manufacturing Example 3

Synthesis of Hybrid Crystalline Polyester Resin (3)

The same procedures were carried out as in the Manufacturing Example 1, except for using raw material monomers of a polycondensation resin (crystalline polyester resin: CPEs2) segment of the composition shown below to obtain a hybrid crystalline polyester resin (3). The number average molecular weight (Mn) of the hybrid crystalline polyester resin (3) is shown in Table 1 below.

Dodecanedioic acid 311.7 parts by mass

Ethylene glycol 80.0 parts by mass

Manufacturing Example 4

Synthesis of Hybrid Crystalline Polyester Resins (4) and (5)

The same procedures were carried out as in the Manufacturing Example 1, except for changing the content of a resin segment other than CPEs (StAc1) based on 100% by mass of the total amount of the hybrid crystalline polyester resin (HB rate) to the content shown in Table 1 below to obtain hybrid crystalline polyester resins (4) and (5). The number average molecular weights (Mn) of the hybrid crystalline polyester resins (4) and (5) are shown in Table 1 below.

Manufacturing Example 5

Synthesis of Non-Hybrid Crystalline Polyester Resin (1)

A 5-L reaction vessel equipped with a stirrer, a temperature sensor, a condenser tube, and a nitrogen introducing unit was charged with 281 parts by mass of tetradecanedioic acid and 206 parts by mass of 1,6-hexanediol, and the internal temperature of the vessel was raised to 190° C. over 1 hour with stirring this system. After it was confirmed that the system is in the uniformly stirred state, $Ti(OBu)_4$ as a catalyst was charged in an amount of 0.003% by mass based on 100% by mass of the charged amount of tetradecanedioic acid. Thereafter, while distilling out the generated water, the internal temperature of the vessel was raised from 190° C. to 240° C. over 6 hours, and further the polymerization was carried out by continuing a dehydration condensation over 6 hours in the condition at a temperature of 240° C. to obtain a non-hybrid crystalline polyester resin (1). The number average molecular weight (Mn) of the non-hybrid crystalline polyester resin (1) is shown in Table 1 below.

Manufacturing Example 6

Synthesis of Non-Hybrid Crystalline Polyester Resin (2)

The same procedures were carried out as in the Manufacturing Example 5, except for changing the raw material monomer composition to 241.5 parts by mass of dodecanedioic acid and 62.1 parts by mass of ethylene glycol to obtain a non-hybrid crystalline polyester resin (2).

Manufacturing Example 7

Synthesis of Non-Hybrid Crystalline Polyester Resin (3)

The same procedures were carried out as in the Manufacturing Example 5, except for changing the raw material monomer composition to 267 parts by mass of dodecanedioic acid and 160 parts by mass of 1,9-nonanediol to obtain a non-hybrid crystalline polyester resin (3). The number average molecular weight (Mn) of the non-hybrid crystalline polyester resin (3) is shown in Table 1 below.

Manufacturing Example 8

Preparation of Aqueous Dispersion Liquid (H1) of Hybrid Crystalline Polyester Resin Fine Particles 30 Parts by mass of the hybrid crystalline polyester resin (1) obtained in the Manufacturing Example 1 was melted, and transferred, in its molten state, to an emulsifying and dispersing machine "CAVITRON CD1010" (manufactured by EUROTEC, LTD.) at a transfer speed of 100 parts by mass per minute. Also, diluted aqueous ammonia of the concentration of 0.37% by mass prepared by diluting 70 parts by mass of reagent aqueous ammonia with an ion exchange water was put into an aqueous medium tank, and the diluted aqueous ammonia was transferred to the emulsifying and dispersing machine at a transfer speed of 0.1 liter per minute while being heated to 100° C. with a heat exchanger, at the same time as the transfer of the hybrid crystalline polyester resin (1) in its molten state. Then, this emulsifying and dispersing machine was driven under the conditions of a rotation speed of the rotor of 60 Hz and a pressure of 5 kg/cm2, to prepare an aqueous dispersion liquid (H1) of the hybrid crystalline polyester resin fine particles having 30 parts by mass of solid content amount. The volume-based median diameter of the resin fine particles contained in the dispersion liquid (H1) is shown in Table 1 below.

Manufacturing Example 9

Preparation of Aqueous Dispersion Liquids (H2) to (H5) of Hybrid Crystalline Polyester Resin Fine Particles The same procedures were carried out as in the Manufacturing Example 8, except for using any of the hybrid crystalline polyester resins (2) to (5) obtained in the Manufacturing Examples 2 to 4, in place of the hybrid crystalline polyester resin (1), to prepare each of aqueous dispersion liquids (H2) to (H5) of the hybrid crystalline polyester resin fine particles. The volume-based median diameters of the resin fine particles contained in the dispersion liquids (H2) to (H5) are shown in Table 1 below.

Manufacturing Example 10

Preparation of Aqueous Dispersion Liquids (N1) to (N3) of Non-Hybrid Crystalline Polyester Resin Fine Particles The same procedures were carried out as in the Manufacturing Example 8, except for using any of the non-hybrid crystalline polyester resins (1) to (3) obtained in the Manufacturing Examples 5 to 7, in place of the hybrid crystalline polyester resin (1), to prepare each of aqueous dispersion liquids (N1) to (N3) of the non-hybrid crystalline polyester resin fine particles. The volume-based median diameters of the resin fine particles contained in the dispersion liquids (N1) to (N3) are shown in Table 1 below.

TABLE 1

| | Crystalline polyester resin | | | | | | Volume-based |
|---|---|---|---|---|---|---|---|
| Aqueous dispersion liquid No. | Type | Carbon number of raw material diol | Carbon number of raw material dicarboxylic acid | Other resin unit (styrene acryl) | HB rate | Number-average molecular weight (Mn) | median diameter of resin fine particles (nm) |
| H1 | Hybrid (1) | 6 | 14 | StAc1 | 10% | 6400 | 131 |
| H2 | Hybrid (2) | 6 | 14 | StAc2 | 10% | 5300 | 102 |
| H3 | Hybrid (3) | 2 | 12 | StAc1 | 10% | 7500 | 118 |
| H4 | Hybrid (4) | 6 | 14 | StAc1 | 20% | 4100 | 189 |
| H5 | Hybrid (5) | 6 | 14 | StAc1 | 50% | 7000 | 256 |

TABLE 1-continued

| Aqueous dispersion liquid No. | Crystalline polyester resin Type | Carbon number of raw material diol | Carbon number of raw material dicarboxylic acid | Other resin unit (styrene acryl) | HB rate | Number-average molecular weight (Mn) | Volume-based median diameter of resin fine particles (nm) |
|---|---|---|---|---|---|---|---|
| N1 | Non-hybrid (1) | 6 | 14 | — | — | 4400 | 175 |
| N2 | Non-hybrid (2) | 2 | 12 | — | — | 3600 | 189 |
| N3 | Non-hybrid (3) | 9 | 12 | — | — | 5800 | 102 |

Manufacturing Example 11

Preparation of Aqueous Dispersion Liquid (X1) of Amorphous Resin Fine Particles <<First Step Polymerization>>

A 5-L reaction vessel equipped with a stirrer, a temperature sensor, a condenser tube, and a nitrogen introducing unit was charged with 8 parts by mass of sodium dodecyl sulfate and 3000 parts by mass of an ion exchange water, and the internal temperature of the vessel was raised to 80° C. with stirring at a stirring rate of 230 rpm in a nitrogen stream. After increasing the temperature, a solution in which 10 parts by mass of potassium persulfate was dissolved in 200 parts by mass of anion exchange water was added thereto, and the solution temperature was again adjusted to 80° C. After dropwise addition of monomers composed of: 480 parts by mass of styrene, 250 parts by mass of n-butyl acrylate and 68 parts by mass of methacrylic acid over 1 hour, then the mixture was heated at 80° C. for 2 hours under stirring to perform polymerization to prepare a dispersion liquid (X1) of resin fine particles.

<<Second Step Polymerization>>

A 5-L reaction vessel equipped with a stirrer, a temperature sensor, a condenser tube, and a nitrogen introducing unit was charged with a solution in which 7 parts by mass of polyoxyethylene (2) dodecylether sodium sulfate was dissolved in 3000 parts by mass of an ion exchange water, and the solution was heated to 98° C. After adding a solution of 260 parts by mass of the dispersion liquid (X1) of resin fine particles and a monomer mixed liquid (including a releasing agent) composed of: 284 parts by mass of styrene, 92 parts by mass of n-butyl acrylate, 13 parts by mass of methacrylic acid, 1.5 parts by mass of n-octyl 3-mercaptopropionate, and 190 parts by mass of a releasing agent: behenyl behenate (melting point of 73° C.), dissolved at 90° C., thereto, the mixture was mixed and dispersed for 1 hour by a mechanical disperser "CLEARMIX" (manufactured by M TECHNIQUE Co., Ltd.) having a circulatory channel, to prepare a dispersion liquid containing emulsified particles (oil droplet).

Subsequently, an initiator solution in which 6 parts by mass of potassium persulfate was dissolved in 200 parts by mass of anion exchange water was added to this dispersion liquid, and this system was heated and stirred at 84° C. over 1 hour to perform polymerization to prepare a dispersion liquid (X2) of resin fine particles.

<<Third Step Polymerization>>

Furthermore, 400 parts by mass of an ion exchange water was added to the dispersion liquid (X2) of resin fine particles, and well mixed, then a solution in which 11 parts by mass of potassium persulfate was dissolved in 400 parts by mass of an ion exchange water was added thereto, and a monomer mixed liquid composed of: 350 parts by mass of styrene, 215 parts by mass of n-butyl acrylate, 30 parts by mass of acrylic acid, and 8 parts by mass of n-octyl 3-mercaptopropionate was added dropwise over 1 hour, under the temperature condition of 82° C. After completion of the dropwise addition, the mixture was heated and stirred over 2 hours to perform polymerization, and then, cooled to 28° C. to prepare an aqueous dispersion liquid (X1) of amorphous resin fine particles composed of a vinyl resin (StAc resin).

The amorphous resin fine particles contained in the resulting aqueous dispersion liquid (X1) of amorphous resin fine particles had a volume-based median diameter of 220 nm, a glass transition temperature (Tg) of 55° C., and a weight average molecular weight (Mw) of 32,000.

Manufacturing Example 12

Preparation of Aqueous Dispersion Liquid (S1) of Amorphous Resin Fine Particles for Shell Raw material monomers of an addition polymerization resin (styrene-acrylic resin) segment of the composition shown below, including a bireactive monomer, and a radical polymerization initiator were added to a dropping funnel.

Styrene 80 parts by mass n-Butyl acrylate 20 parts by mass

Acrylic acid 10 parts by mass

Polymerization initiator (di-t-butyl peroxide) 16 parts by mass

Also, raw material monomers of the following polycondensation resin (amorphous polyester resin) segment was charged to a four-neck flask equipped with a nitrogen introducing tube, a dewatering tube, a stirrer, and a thermocouple, and dissolved by heating to 170° C.

Bisphenol-A propylene oxide 2 mol adduct 285.7 parts by mass

Terephthalic acid 66.9 parts by mass

Fumaric acid 47.4 parts by mass

Subsequently, the raw material monomers of the addition polymerization resin were added dropwise over 90 minutes while stirring the contents of the flask, and the mixture was aged for 60 minutes, then the raw material monomers of unreacted addition polymerization resin was removed under reduced pressure (8 kPa). The monomer amount removed at that time was a very small amount with respect to the raw material monomer ratio of the resin.

Thereafter, 0.4 parts by mass of $Ti(OBu)_4$ was charged as an esterification catalyst, and the temperature was increased to 235° C., then the reaction was performed under normal pressure (101.3 kPa) for 5 hours and further under reduced pressure (8 kPa) for 1 hour.

Next, the reactant was cooled to 200° C., then reacted under reduced pressure (20 kPa) until reaching to a desired softening point. Subsequently, desolvation was carried out to obtain a resin for a shell (s1) as an amorphous resin. The resulting resin for a shell (s1) had a glass transition temperature (Tg) of 60° C., and a weight average molecular weight (Mw) of 66,700.

100 Parts by mass of the resulting resin for a shell (s1) was dissolved in 400 parts by mass of ethyl acetate (manufactured by KANTO CHEMICAL CO., INC.), and then mixed with 638 parts by mass of a sodium dodecyl sulfate solution prepared with a concentration of 0.26% by mass in advance. The mixture was subjected to ultrasonic dispersion at a V-LEVEL of 300 pA for 30 minutes using an ultrasonic homogenizer "US-150T" (manufactured by NIHONSEIKI KAISHA LTD.) while the mixture was stirred. Thereafter, in a heated state at 40° C., the ethyl acetate was completely removed under reduced pressure while stirring for 3 hours, using a diaphragm type vacuum pump "V-700" (manufactured by BUCHI), to prepare an aqueous dispersion liquid (S1) of amorphous resin fine particles for a shell having 13.5% by mass of solid content amount. The volume-based median diameter of the resin fine particles contained in the dispersion liquid (S1) was 160 nm.

Manufacturing 13

Preparation of Aqueous Dispersion Liquid (Cy1) of Colorant Fine Particles

90 Parts by mass of sodium dodecyl sulfate was added to 1600 parts by mass of an ion exchange water. While stirring this solution, 420 parts by mass of copper phthalocyanine (C.I. Pigment Blue 15:3) was slowly added, and subsequently dispersed using a stirrer "CLEARMIX" (manufactured by M TECHNIQUE Co., Ltd.) to prepare an aqueous dispersion liquid (Cy1) of colorant fine particles. The volume-based median diameter of the colorant fine particles contained in the dispersion liquid (Cy1) was 110 nm.

Example 1

Preparation of Toner (1)

A reaction vessel equipped with a stirrer, a temperature sensor, and a condenser tube was charged with 195 parts by mass (in terms of solid content) of the aqueous dispersion liquid (X1) of amorphous resin fine particles, 15 parts by mass (in terms of solid content) of the aqueous dispersion liquid (H1) of the hybrid crystalline polyester resin fine particles, and 15 parts by mass (in terms of solid content) of the aqueous dispersion liquid (N1) of the non-hybrid crystalline polyester resin fine particles, and 2000 parts by mass of an ion exchange water, then a 5 mol/liter aqueous sodium hydroxide solution was added thereto to adjust a pH of the solution to 10.

Thereafter, 40 parts by mass (in terms of solid content) of the aqueous dispersion liquid (Cy1) of colorant fine particles was charged, and subsequently, a solution in which 60 parts by mass of magnesium chloride was dissolved in 60 parts by mass of an ion exchange water was added thereto at 30° C. over 10 minutes while stirring. The temperature of this system was increased to 82° C. over 60 minutes, and the particle growth reaction was continued while maintaining at 82° C. In this state, the particle diameter of the aggregate particles was measured with "Coulter Multisizer 3" (manufactured by Beckman Coulter, Inc.), and at the time when the volume-based median diameter reached 6.0 μm, an aqueous solution was cooled to 79° C., and 75 parts by mass (in terms of solid content) of the aqueous dispersion liquid (S1) of amorphous resin fine particles for a shell was charged over 30 minutes. At the time when the supernatant of the reaction liquid becomes transparent, the reaction liquid was cooled to 74° C., and an aqueous solution prepared by dissolving 190 parts by mass of sodium chloride in 760 parts by mass of an ion exchange water was added to stop the particle growth. The mixture was heated and stirred at 74° C. so that the fusion of the particles was allowed to proceed. At the time when the average circularity of the particles measured with a measurement system for a toner average circularity "FPIA-2100" (manufactured by Sysmex Corporation) (4,000 in HPF detection number) reached 0.945, the mixture was cooled to 30° C. at a cooling rate of 2.5° C./min.

Subsequently, a toner cake that was separated into solid and dehydrated was washed by repeating an operation of being redispersed in an ion exchange water and separated into solid for 3 times, then dried at 40° C. for 24 hours to obtain toner particles (1×).

The following external additive treatment was carried out. Specifically, to 100 parts by mass of the resulting toner particles (1×) were added 0.6 parts by mass of hydrophobic silica (number average primary particle diameter=12 nm, and hydrophobicity=68) and 1.0 part by mass of hydrophobic titanium oxide (number average primary particle diameter=20 nm, and hydrophobicity=63), and the mixture was mixed at a rotor blade circumferential speed of 35 mm/sec, at 32° C. for 20 minutes, by using a "Henschel mixer" (manufactured by Mitsui Miike Machinery Co., Ltd). Then, the coarse particles were removed by using a sieve with a mesh opening of 45 μm, to prepare toner (1).

Example 2

Preparation of Toner (2)

The same procedures were carried out as in the Example 1 described above, except for using the aqueous dispersion liquid (N2) of the non-hybrid crystalline polyester resin fine particles, in place of the aqueous dispersion liquid (N1) of the non-hybrid crystalline polyester resin fine particles, to prepare toner (2).

Example 3

Preparation of Toner (3)

The same procedures were carried out as in the Example 1 described above, except for changing the added amount of the aqueous dispersion liquid (H1) of the hybrid crystalline polyester resin fine particles to 25 parts by mass, and the added amount of the aqueous dispersion liquid (N1) of the non-hybrid crystalline polyester resin fine particles to 5 parts by mass, to prepare toner (3).

Example 4

Preparation of Toner (4)

The same procedures were carried out as in the Example 1 described above, except for changing the added amount of the aqueous dispersion liquid (H1) of the hybrid crystalline polyester resin fine particles to 5 parts by mass, and the added amount of the aqueous dispersion liquid (N1) of the non-hybrid crystalline polyester resin fine particles to 25 parts by mass, to prepare toner (4).

Example 5

Preparation of Toner (5)

The same procedures were carried out as in the Example 1 described above, except for not adding the aqueous dispersion liquid (H1) of the hybrid crystalline polyester resin fine particles on the charging, but adding it at the time when the particle diameter (the volume-based median diameter) of the aggregate particles reached 6.0 μm, to prepare toner (5).

Example 6

Preparation of Toner (6)

The same procedures were carried out as in the Example 1 described above, except for not adding the aqueous dispersion liquid (N1) of the non-hybrid crystalline polyester resin fine particles on the charging, but adding it at the time when the particle diameter (the volume-based median diameter) of the aggregate particles reached 6.0 μm, to prepare toner (6).

Example 7

Preparation of Toner (7)

The same procedures were carried out as in the Example 1 described above, except for not adding the aqueous dispersion liquid (H1) of the hybrid crystalline polyester resin fine particles and the aqueous dispersion liquid (N1) of the non-hybrid crystalline polyester resin fine particles on the charging, but adding those at the time when the particle diameter (the volume-based median diameter) of the both aggregate particles reached 6.0 μm, to prepare toner (7).

Examples 8 to 10

Preparation of Toners (8) to (10)

The same procedures were carried out as in the Example 1 described above, except for using any of the aqueous dispersion liquids (H2) to (H4) of the hybrid crystalline polyester resin fine particles, in place of the aqueous dispersion liquid (H1) of the hybrid crystalline polyester resin fine particles, to prepare toners (8) to (10).

Example 11

Preparation of Toner (11)

The same procedures were carried out as in the Example 1 described above, except for not using the aqueous dispersion liquid (N1) of the non-hybrid crystalline polyester resin fine particles, and using the aqueous dispersion liquid (H5), in place of the aqueous dispersion liquid (H1) as the aqueous dispersion liquid of the hybrid crystalline polyester resin fine particles, and changing the added amount of the aqueous dispersion liquid (H5) to 30 parts by mass, to prepare toner (11).

Comparative Example 1

Preparation of Toner (12)

The same procedures were carried out as in the Example 1 described above, except for using neither the aqueous dispersion liquid (H1) of the hybrid crystalline polyester resin fine particles nor the aqueous dispersion liquid (N1) of the non-hybrid crystalline polyester resin fine particles, to prepare toner (12).

Comparative Example 2

Preparation of Toner (13)

The same procedures were carried out as in the Example 1 described above, except for not using the aqueous dispersion liquid (H1) of the hybrid crystalline polyester resin fine particles, and using the aqueous dispersion liquid (N3) of the non-hybrid crystalline polyester resin fine particles, in place of the aqueous dispersion liquid (N1) of the non-hybrid crystalline polyester resin fine particles, and changing the added amount of the aqueous dispersion liquid (N3) to 30 parts by mass, to prepare toner (13).

Comparative Example 3

Preparation of Toner (14)

The same procedures were carried out as in the Comparative Example 2 described above, except for not adding the aqueous dispersion liquid (N3) of the non-hybrid crystalline polyester resin fine particles on the charging, but adding it at the time when the particle diameter (the volume-based median diameter) of the aggregate particles reached 6.0 μm, to prepare toner (14).

<Preparation of Developer>

Ferrite carriers coated with a silicone resin and having a volume-based median diameter of 60 μm were added and mixed to each of the toners (1) to (14) prepared in the Examples 1 to 11 and the Comparative Examples 1 to 3, so as to have a toner concentration of 6% by mass, to prepare each of developers (1) to (14).

<Evaluation of Toner and Developer>

(Observation of Cross Section of Toner Particles)

Device: transmission electron microscope "JEM-2000FX" (manufactured by JEOL, Ltd.)

Sample: section of toner particles stained by ruthenium tetroxide ($RuO_4$) (thickness of section: 60 to 100 nm)

Acceleration voltage: 80 kV

Magnification: 50,000 times, bright-field image

Method for Preparing Section of Toner Particles 10 mg of the toner particles is stained once or twice under ruthenium tetroxide ($RuO_4$) steam staining conditions shown below, then dispersed in a photo-curable resin "D-800" (manufactured by JEOL, Ltd.), and allowed to cure under UV light, to form a block. Subsequently, using a microtome equipped with a diamond blade, an ultrathin sample with a thickness of 60 to 100 nm is sliced from the block.

Ruthenium Tetroxide Staining Conditions

Staining is performed using a vacuum electron staining apparatus VSC1R1 (manufactured by Filgen, Inc). In accordance with the apparatus procedures, a sublimation chamber containing ruthenium tetroxide was installed in the main body of the staining apparatus, and the ultrathin section prepared above was introduced into the staining chamber. Thereafter, as conditions of staining by ruthenium tetroxide, the staining was performed under the conditions of room temperature (24 to 25° C.) and concentration 3 (300 Pa), for 10 minutes.

Observation of Crystal Structure

After staining, the section was observed with a transmission electron microscope "JEM-2000FX" (manufactured by JEOL, Ltd.) within 24 hours. At that time, the existing position of lamellar crystal structures and fibrous crystal structures in the cross section of the toner base particles constituting the toner particles was observed. The result is shown in Table 2 below. Here, the "inside" in Table 2 means that the corresponding crystal structure is only present in the region 0.1 times or more of the particle size (the volume-based median diameter) of the toner base particles in depth. Also, the "outside to inside" means that the corresponding crystal structure is also present in the region other than the above region (namely, the region shallower than 0.1 times of the particle size (the volume-based median diameter) of the toner base particles in depth), not only in the above region (namely, dispersed in the entire toner base particles).

(Method for Measuring Size of Crystal Structure)

The domain diameter of lamellar crystal structures and fibrous crystal structures in the cross section of the toner base particles is calculated as maximum horizontal chord length (CORD H) of each crystal structure. Specifically, the cross section on the sample prepared as described above was photographed at 50,000 magnification at an acceleration voltage of 80 kV by a scanning electron microscope JEM-2000FX (manufactured by JEOL Ltd.), and picture images were scanned. Then, a maximum horizontal chord length (CORDH) of each crystal structure was measured using image processing analysis equipment LUZEX AP (manufactured by Nireco Corporation).

Also, the major diameter (length) and minor diameter (width) of the fibrous crystal structures were similarly measured. At that time, measurement of the crystal structure was performed for 100 toner particles, and the domain diameter was calculated as an arithmetic average value for those in which the crystal structures were observed, among the measured 100 toner particles. The result is shown in Table 2 below.

Also, in the same manner as the method for measuring a domain diameter as described above, the cross-sectional area ratio of the crystal structure (lamellar crystal structures and fibrous crystal structures) to the cross-sectional area of the toner base particles constituting the toner particles was determined using "AREA". The result is shown in Table 2 below.

TABLE 2

| | | Crystalline polyester resin | | Amount of crystalline polyester resin (part by mass) | | Charge timing of crystalline polyester resin | | Size of crystal structure of crystalline resin (average domain diameter) | | | Existing position of crystal structure | | Total cross-sectional area of crystal structure (%) |
|---|---|---|---|---|---|---|---|---|---|---|---|---|---|
| | | | | Hybrid | Non-hybrid | Hybrid | Non-hybrid | Lamellar (nm) | Fibrous (long diameter nm) | Fibrous (short diameter nm) | Lamellar | Fibrous | |
| Example 1 | Toner (1) | Hybrid (1) | Non-hybrid (1) | 15 | 15 | On charging | On charging | 1000 | 500 | 50 | Inside | Inside | 12 |
| Example 2 | Toner (2) | Hybrid (1) | Non-hybrid (2) | 15 | 15 | On charging | On charging | 1100 | 300 | 40 | Inside | Inside | 13 |
| Example 3 | Toner (3) | Hybrid (1) | Non-hybrid (1) | 25 | 5 | On charging | On charging | 1100 | 450 | 40 | Inside | Inside | 10 |
| Example 4 | Toner (4) | Hybrid (1) | Non-hybrid (1) | 5 | 25 | On charging | On charging | 900 | 450 | 50 | Inside | Inside | 10 |
| Example 5 | Toner (5) | Hybrid (1) | Non-hybrid (1) | 15 | 15 | Particle size of 6 μm | On charging | 1000 | 500 | 45 | Inside to outside | Inside | 15 |
| Example 6 | Toner (6) | Hybrid (1) | Non-hybrid (1) | 15 | 15 | On charging | Particle size of 6 μm | 900 | 400 | 50 | Inside | Inside to outside | 8 |
| Example 7 | Toner (7) | Hybrid (1) | Non-hybrid (1) | 15 | 15 | Particle size of 6 μm | Particle size of 6μm | 1200 | 500 | 45 | Inside to outside | Inside to outside | 15 |
| Example 8 | Toner (8) | Hybrid (2) | Non-hybrid (1) | 15 | 15 | On charging | On charging | 1600 | 450 | 50 | Inside | Inside | 18 |
| Example 9 | Toner (9) | Hybrid (3) | Non-hybrid (1) | 15 | 15 | On charging | On charging | 800 | 600 | 35 | Inside | Inside | 8 |
| Example 10 | Toner (10) | Hybrid (4) | Non-hybrid (1) | 15 | 15 | On charging | On charging | 1800 | 500 | 20 | Inside | Inside | 20 |
| Example 11 | Toner (11) | Hybrid (5) | — | 30 | 0 | On charging | — | 1000 | 300 | 20 | Inside | Inside | 13 |
| Comparative Example 1 | Toner (12) | — | — | 0 | 0 | — | — | — | — | — | — | — | — |
| Comparative Example 2 | Toner (13) | — | Non-hybrid (3) | 0 | 30 | — | On charging | — | 550 | 45 | — | Inside | 8 |

TABLE 2-continued

| | | | Amount of crystalline polyester resin (part by mass) | | Charge timing of crystalline polyester resin | | Size of crystal structure of crystalline resin (average domain diameter) | | | Existing position of crystal structure | | Total cross-sectional area of crystal structure (%) |
|---|---|---|---|---|---|---|---|---|---|---|---|---|
| | | Crystalline polyester resin | Hybrid | Non-hybrid | Hybrid | Non-hybrid | Lamellar (nm) | Fibrous (long diameter nm) | Fibrous (short diameter nm) | Lamellar | Fibrous | |
| Comparative Example 3 | Toner (14) | — Non-hybrid (3) | 0 | 30 | — | Particle size of 6 μm | — | 450 | 50 | — | Inside to outside | 9 |

(Evaluation of Low Temperature Fixability)

Using a commercially available full-color multifunctional machine "bizhub C754" (manufactured by Konica Minolta, Inc.) that is modified so that the surface temperature of a fixing upper belt and a fixing lower roller can be changed, as an image forming apparatus, mounting each of the developers (1) to (14) as a developer, a test of outputting a solid image of a toner adhesion amount of 11.3 g/m2 on a recording material "mondi Color Copy A4 90 g/m2" (manufactured by mondi), in an environment of normal temperature and normal humidity (temperature of 20° C., humidity of 50% RH), at a nip width of 11.2 mm, a fixing time of 34 msec, a fixing pressure of 133 kPa, and a fixing temperature of 100 to 200° C., was repeatedly performed while changing the fixing temperature by 5° C. until cold offset occurs. Moreover, the lowest surface temperature of the fixing upper belt at which cold offset does not occur was investigated, and low temperature fixability was evaluated with this temperature as the fixing lower limit temperature. The result is shown in Table 3 below. Here, in each test, the "fixing temperature" refers to the surface temperature of the fixing upper belt. Also, the lower the fixing lower limit temperature, the more excellent in the low temperature fixability it shows.

(Evaluation of High-Speed Fixability)

Using a commercially available full-color multifunctional machine "bizhub C754" (manufactured by Konica Minolta, Inc.) that is modified so that the surface temperature of a fixing upper belt and a fixing lower roller can be changed, as an image forming apparatus, mounting each of the developers (1) to (14) as a developer, unfixed images (the "solid image" as in the "Evaluation of low temperature fixability") in each process speed were fixed while setting an initial process speed to 200 mm/sec and sequentially increasing the set speed by 25 mm/sec, in an environment of normal temperature and normal humidity (temperature of 20° C., humidity of 50% RH). The set temperature was the fixing lower limit temperature of each toner in the evaluation of low temperature fixability. The upper limit value of process speed in which low temperature offset was not observed, and the rank was 2 or more when the obtained fixed image was folded using a folding machine, an air of 0.35 MPa was blown to the folded fixed image, and the condition of the fold was evaluated on the following scale of one to five with reference to a limit sample, was defined as the fixable process speed (fixable linear velocity). In addition, the rank of the fold on the fixable linear velocity was evaluated on the following scale of one to five. The result is shown in Table 3 below. Here, the case where the fixable linear velocity was 300 mm/sec or more and the rank of the fold was 3 to 5 was defined as acceptable level.

Rank 5: no peeling at all on the fold;

Rank 4: peeling found along a part of the fold;

Rank 3: fine linear peeling found along the fold;

Rank 2: bold peeling found along the fold;

Rank 1: major peeling found on the image.

(Evaluation of Fixable Temperature Range)

Using a commercially available full-color multifunctional machine "bizhub C754" (manufactured by Konica Minolta, Inc.) that is modified so that the surface temperature of a fixing upper belt and a fixing lower roller can be changed, as an image forming apparatus, a test of outputting a solid image of a toner adhesion amount of 11.3 g/m2 on a recording material "mondi Color CopyA4 90 g/m2" (manufactured by mondi), in an environment of normal temperature and normal humidity (temperature of 20° C., humidity of 50% RH), at a nip width of 11.2 mm, a fixing time of 34 msec, and a fixing pressure of 133 kPa, was performed while changing the surface temperature of a heating roller (measured in the center of the roller) of the image forming apparatus in the range of 100 to 200° C. by 5° C., and the temperature region in which an image defect caused by fixing offset (non-offset region) does not occur was determined, to evaluate based on the following evaluation criteria from the determination result. The result is shown in Table 3 below. Here, the case where the fixable linear velocity was ranked evaluation A or evaluation B was defined as acceptable level.

A: the lower limit temperature of non-offset region is 150° C. or lower;

B: the lower limit temperature of non-offset region is 155 to 160° C.;

C: the lower limit temperature of non-offset region is 165° C. or higher.

(Evaluation of Heat-Resistant Storage Property (50% Aggregation Temperature))

0.5 g of the toner was put in a 10 mL-glass bottle with an inner diameter of 21 mm, and the cap thereof was closed to be shaken by 600 times using a shaker "tap denser KYT-2000" (manufactured by Seishin Enterprise Co., Ltd.) at room temperature. Thereafter, the cap was taken off, and the glass bottle was left as it was in an environment of a temperature of 55° C. and a humidity of 35% RH for 2 hours. Next, the toner was carefully placed on a sieve of 48 meshes (aperture 350 μm) so as not to be shredded, and was set in "Powder Tester" (manufactured by Hosokawa Micron Corporation) to be fixed with a pressure bar and a knob nut. The toner was vibrated for 10 seconds after adjusting "Powder Tester" to the vibration strength of a feed width of 1 mm. Then, the ratio (% by mass) of the toner amount remaining on the sieve was measured, and the toner aggregation rate was calculated by the following formula. This test was repeatedly performed while maintaining the humidity at 35% RH and raising the test temperature by 0.1° C. until the toner aggregation rate exceeds 50% by mass. The highest test temperature (limit heat-resistant storage temperature) at which the toner aggregation rate does not exceed 50% by mass was used as the index of heat-resistant storage property. The result is shown in Table 3 below. Here, the case where the limit heat-resistant storage temperature was 56.5° C. or more was defined as acceptable level.

Toner aggregation rate (% by mass)=Mass of toner remaining on sieve (g)/0.5 (g)×100

(Evaluation of Toner Flowability)

The bulk density was obtained by a Kawakita-type bulk density meter (IH2000 model) as the index of toner flowability. Specific measurement method of the bulk density is as follows.

The toner to be measured was left over night in an environment of normal temperature and normal humidity (20° C., 50% RH), then, 20 g of the sample was placed on a sieve of 48 meshes, and dropped for 30 seconds at a vibration strength of 6. Thereafter, the vibration was stopped and left to stand for 3 minutes, and the level bulk density (toner weight/volume (20 $cm^3$)) was obtained. The obtained value was evaluated based on the following evaluation criteria.

The result is shown in Table 3 below. Here, the case where the evaluation was ranked 0 to A was defined as acceptable level.

○: the level bulk density is 40 g/100 ml or more (toner flowability is excellent);

Δ: the level bulk density is 35 g/100 ml or more and less than 40 g/100 ml (toner flowability is practical);

X: the level bulk density is less than 35 g/100 ml (toner flowability is not good).

TABLE 3

| | | Toner evaluation | | | | | |
|---|---|---|---|---|---|---|---|
| | | Low temperature fixability Fixing lower limit temperature (° C.) | High-speed fixability | | Fixable temperature range | Heat-resistant storage property (50% aggregation temperature) (° C.) | Toner flowability |
| | | | Fixable linear velocity | Rank of fold | | | |
| Example 1 | Toner (1) | 150 | 300 | 4 | A | 58.5 | ○ |
| Example 2 | Toner (2) | 150 | 300 | 3 | A | 59 | ○ |
| Example 3 | Toner (3) | 150 | 300 | 3 | A | 59.5 | ○ |
| Example 4 | Toner (4) | 150 | 300 | 4 | A | 58.5 | ○ |
| Example 5 | Toner (5) | 155 | 300 | 3 | A | 58 | Δ |
| Example 6 | Toner (6) | 155 | 300 | 3 | A | 58 | Δ |
| Example 7 | Toner (7) | 150 | 300 | 4 | A | 58 | Δ |
| Example 8 | Toner (8) | 155 | 300 | 3 | A | 59 | ○ |
| Example 9 | Toner (9) | 150 | 300 | 3 | A | 59 | ○ |
| Example 10 | Toner (10) | 150 | 300 | 3 | A | 59 | ○ |
| Example 11 | Toner (11) | 155 | 300 | 3 | B | 59 | ○ |
| Comparative Example 1 | Toner (12) | 180 | 250 | 1 | C | 62 | ○ |
| Comparative Example 2 | Toner (13) | 150 | 275 | 3 | C | 57 | ○ |
| Comparative Example 3 | Toner (14) | 150 | 275 | 3 | C | 57 | x |

It can be seen based on the result shown in Table 3, with a developer using the toner according to the present invention, not only achieving excellent low temperature fixability, but also performance such as high-speed fixability and fixable temperature range can be improved. Also, it was confirmed that the toner according to the present invention shows high heat-resistant storage property, and also has good flowability.

What is claimed is:

1. An electrostatic charge image developing toner comprising toner base particles containing an amorphous resin and a crystalline resin, wherein the crystalline resin forms lamellar crystal structures and fibrous crystal structures, and the lamellar crystal structures and the fibrous crystal structures are dispersed in the cross section of the toner base particles.

2. The electrostatic charge image developing toner according to claim 1, wherein the crystalline resin is a crystalline polyester resin.

3. The electrostatic charge image developing toner according to claim 1, wherein the average domain diameter of the lamellar crystal structures is 0.1 to 2 μm, and the domain diameter of the fibrous crystal structures is 2 μm or less in major diameter (average) and 0.01 to 1 μm in minor diameter (average).

4. The electrostatic charge image developing toner according to claim 1, wherein, in the cross section, the lamellar crystal structures are present in the region 0.1 times or more of the particle size of the toner base particles in depth from the surface of the toner base particles, and the fibrous crystal structures are dispersed over the entire toner base particles.

5. The electrostatic charge image developing toner according to claim 1, wherein, in the cross section, the lamellar crystal structures and. the fibrous crystal structures are both present in the region 0.1 times or more of the particle size of the toner base particles in depth from the surface of the toner base particles.

6. The electrostatic charge image developing toner according to claim 1, wherein the ratio of the total cross-sectional area of the lamellar crystal structures and the fibrous crystal structures to the cross-sectional area is 1 to 50%.

7. The electrostatic charge image developing toner according to claim 1, wherein the crystalline resin contains a hybrid crystalline polyester resin formed by chemical bonding of a polyester polymerization segment and other polymerization segment.

8. The electrostatic charge image developing toner according to claim 7, wherein the other polymerization segment is a vinyl polymerization segment.

9. The electrostatic charge image developing toner according to claim 7, wherein the crystalline resin further contains a non-hybrid crystalline polyester resin not containing a chemical bond of a polyester polymerization segment and other polymerization segment.

10. The electrostatic charge image developing toner according to claim 9, wherein the content of the other polymerization segment in the hybrid crystalline polyester resin is 5 to 30% by mass based on 100% by mass of the hybrid crystalline polyester resin.

11. The electrostatic charge image developing toner according to claim 7, wherein the crystalline resin does not further contain a non-hybrid crystalline polyester resin not containing a chemical bond of a polyester polymerization segment and other polymerization segment.

12. The electrostatic charge image developing toner according to claim 9, wherein the content of the other polymerization segment in the hybrid crystalline polyester resin is 40% by mass or more based on 100% by mass of the hybrid crystalline polyester resin.

13. The electrostatic charge image developing toner according to claim 1, wherein the content of the crystalline resin in the toner base particles is 0.1 to 50 parts by mass based on 100 parts by mass of the amorphous resin.

14. A method for manufacturing the electrostatic charge image developing toner as defined in claim 1, comprising:

adding a dispersion liquid (a) containing amorphous resin fine particles and a dispersion liquid (b) containing crystalline resin fine particles to an aqueous medium to prepare a mixed dispersion liquid;

increasing the temperature of the mixed dispersion liquid to aggregate the amorphous resin fine particles and the crystalline resin fine particles to form core particles; and adding a dispersion liquid for a shell (c) containing amorphous resin fine particles to the mixed dispersion liquid to form a shell in the surface of the core particles.

15. The electrostatic charge image developing toner according to claim 1, wherein, in the cross section, the lamellar crystal structures are present in the region 0.1 times or more of the particle size of the toner base particles in depth from the surface of the toner base particles.

16. The electrostatic charge image developing toner according to claim 1, wherein, in the cross section, the lamellar crystal structures are present only in the region 0.1 times or more of the particle size of the toner base particles in depth from the surface of the toner base particles.

17. The electrostatic charge image developing toner according to claim 1, wherein, in the cross section, the lamellar crystal structures are present only in the region 0.1 times or more of the particle size of the toner base particles in depth from the surface of the toner base particles, and the fibrous crystal structures are dispersed over the entire toner base particles.

18. The electrostatic charge image developing toner according to claim 1, wherein, in the cross section, the lamellar crystal structures and the fibrous crystal structures are both present only in the region 0.1 times or more of he particle size of the toner base particles in depth from the surface of the toner base particles.

* * * * *